United States Patent [19]

Schroeter et al.

[11] 4,032,673

[45] June 28, 1977

[54] METHOD FOR APPLYING AN ORGANIC COATING ONTO AN INORGANIC COATED STEEL SHEET

[75] Inventors: Siegfried H. Schroeter, Schenectady, N.Y.; Jon VanWinkle, Dalton; Carroll B. French, Lenox, both of Mass.

[73] Assignee: General Electric Company, Schenectady, N.Y.

[22] Filed: Sept. 19, 1975

[21] Appl. No.: 614,793

Related U.S. Application Data

[63] Continuation-in-part of Ser. No. 444,859, Feb. 22, 1974, Pat. No. 3,924,022.

[52] U.S. Cl. ..... 427/54; 204/159.14; 336/219; 427/127; 427/403; 427/409

[51] Int. Cl.[2] ..... B05D 3/06

[58] Field of Search ..... 427/44, 54, 104, 131, 427/127, 403, 409; 204/159.14; 336/219

[56] References Cited

UNITED STATES PATENTS

| | | | |
|---|---|---|---|
| 2,533,351 | 12/1950 | Carpenter | 148/6.35 |
| 3,666,568 | 5/1972 | Shimanaka et al. | 148/6.2 |
| 3,794,576 | 2/1974 | Watt | 427/54 |

*Primary Examiner*—John H. Newsome
*Attorney, Agent, or Firm*—William A. Teoli; Joseph T. Cohen; Jerome C. Squillaro

[57] ABSTRACT

A method is provided for improving the insulating characteristics of oriented steel sheet having an inorganic surface coating to produce an organic resin-in-organic coating-oriented steel sheet composite. Certain irradiation curable solventless organic resins can be applied to the surface of the oriented steel sheet in a pollution free manner. The resulting composite can be used as power transformer core laminate.

8 Claims, 2 Drawing Figures

METHOD FOR APPLYING AN ORGANIC COATING ONTO AN INORGANIC COATED STEEL SHEET

Figure 1:
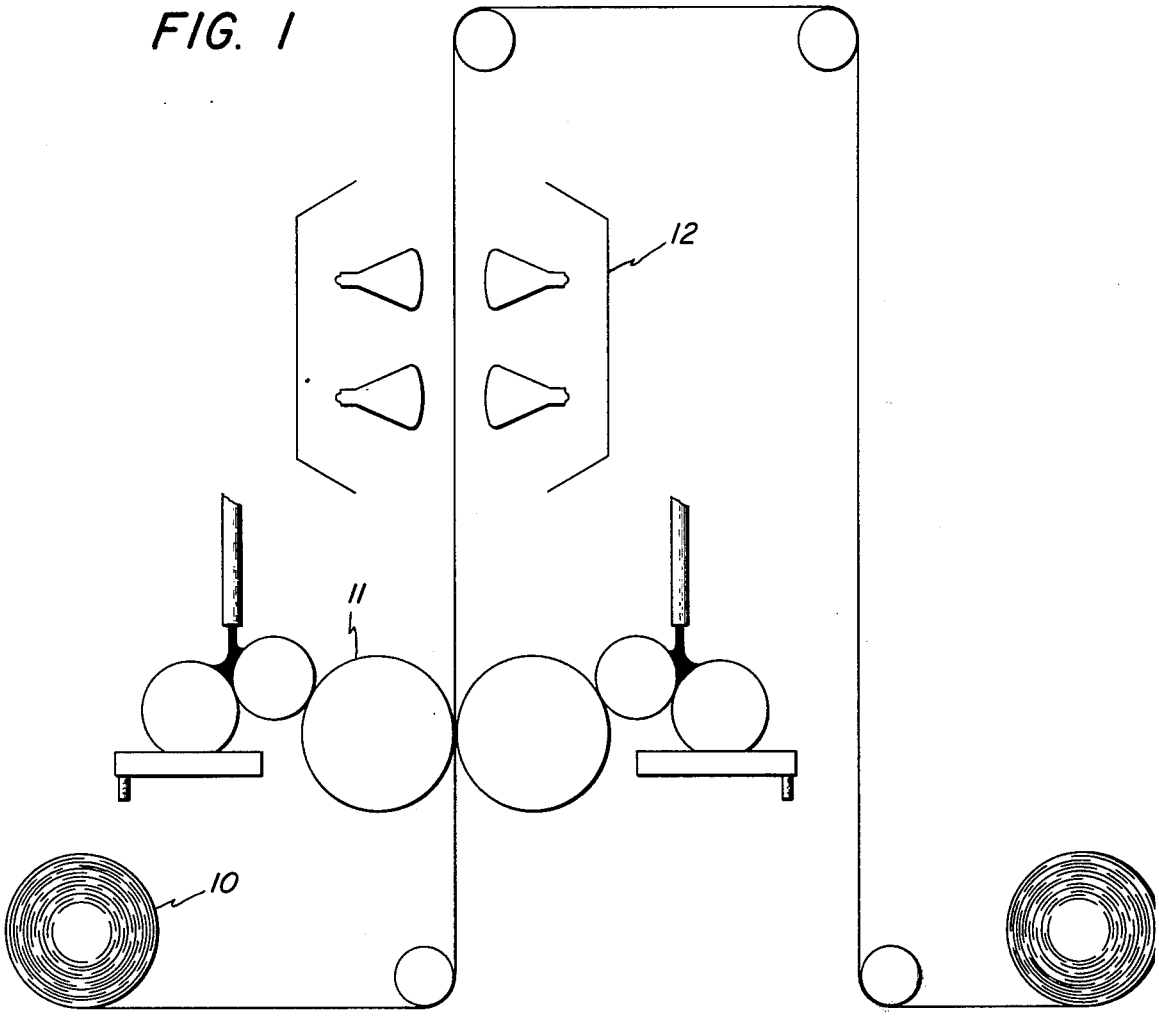

This application is a continuation in part of copending application Ser. No. 444,859, filed Feb. 22, 1974, now U.S. Pat. No. 3,924,022 which is assigned to the same assignee as the present invention.

The present invention relates to the use of certain irradiation curable solventless organic resins for imparting improved insulating characteristics to oriented steel having an inorganic insulating coating. More particularly, the present invention relates to a substantially, pollution free process for making power transformer core laminate.

Prior to the present invention, transformer core laminate was generally made from oriented steel strip commonly referred to as "magnetic or silicon steel" having an inorganic surface insulating coating such as a magnesium oxide or silicate, as shown, for example, in Carpenter, et al., U.S. Pat. Nos. 2,385,332 and 2,533,351, or having an inorganic phosphate coated oriented steel as shown by Gifford U.S. Pat. Nos. 2,492,095 and 2,501,846, etc. Further examples of inorganic coating materials for imparting improved insulating characteristics to magnetic sheet material are shown by Hirst U.S. Pat. Nos. 3,562,011, 3,705,549 and 3,705,825, as assigned to the same assignee as the present invention.

Although oriented steel processed by the above-described methods provides useful transformer core laminate, it was found that in many instances the inorganic coating did not insure adequate insulation. The inorganic coating, for example, often had surface imperfections which caused variations in surface resistivity, when oriented steel strip was subjected to standard electrical and mechanical tests such as the Franklin test ASTM A344-68. Those skilled in the art also know that if the transformer core is not properly insulated, severe core damage can occur in the event the transformer is struck by lightning. A high voltage surge can result in permanent core insulation breakdown, resulting in higher core losses.

It has been found that improved insulating characteristics can be imparted to inorganic coated oriented steel strip by coating the steel strip with an organic resin. An organic resin-inorganic coating-oriented steel strip composite has been made by treating the oriented steel strip with a hydrocarbon solvent solution of a phenol-formaldehyde resin. Although transformer core laminate having improved insulating performance can be made by use of such organic resin, the cure of the resin requires a baking step. Cure of the organic resin can require 1 to 3 minutes, rendering the method undesirable for high-speed continuous operation. In addition, means for hydrocarbon solvent removal must be provided to avoid air pollution.

In addition to the requirement of insuring adequate insulation, those skilled in the power transformer art know that the core consisting of hundreds of thin laminations in the form of high grade silicon steel strips cut to size, must be immersed in 10C hydrocarbon oil. Oil immersion is required to improve heat transfer and to reduce corona around the core and coils which could seriously damage and impair the operating efficiency of the transformer. Experience has shown that the organic resin must be hydrolytically stable at temperatures up to about 100° C for a period of about 30 years in the hydrocarbon oil to satisfy manufacturing requirements. Premature breakdown of the organic resin not only will result in insulation failure of the transformer core, but can also lead to the breakdown and reduction in the effectiveness of the hydrocarbon oil to reduce corona.

A further criterion that a cured organic resin must possess before it will meet the specifications of power transformer manufacturers is that shrinkage upon cure will not have negative effects on properties. Those skilled in the transformer art know that shrinkage of certain coatings on the surface of the oriented steel strip can alter the magnetostriction characteristic of the steel. Even a slight increase in magnetostriction due to surface stress can result in substantial transformer hum.

The present invention is based on the discovery that certain solventless irradiation curable organic resins, which are defined more particularly hereinafter, and include both electron-beam curable and ultraviolet light curable resins, can be used to continuously make oriented steel-inorganic coating organic resin composites in a pollution free manner. The composites made in accordance with the practice of the invention can be used as power transformer core laminates and are equivalent or superior in all respects to the core laminates made in accordance with the prior art procedures. This result is quite surprising since many available irradiation curable organic resins, such as shown by Patheiger, et al. U.S. Pat. No. 3,531,317 cannot be employed to produce suitable power transformer core laminate. In addition to imparting improved resistivity to inorganic material coated oriented steel strip, one of the vital criteria required for operable solventless irradiation curable resins in accordance with the practice of the invention is "hydrolytic stability" or the ability to resist insulation breakdown during immersion in 10C hydrocarbon oil over a 30-year period under average operating conditions of 100° C. A further criterion employed is heat-stability. A weight loss test using a cured resin sample can be used to screen for heat stability whereby a weight loss of up to 10% can be tolerated over a temperature range of 150° C to 160° C over a 1,000 hour period.

A vital test for screening resins based on contamination of the transformer oil and alteration of its dielectric properties is the IFT test, ASTM D971-50 Interfacial Tension of Oil Against Water, shown on page 322 of the 1970 Annual Book of ASTM Standards, part 17 (November). It has been found that the IFT test can readily identify operable solventless irradiation curable organic resins, which can be employed in the practice of the invention. A procedure which can be employed is as follows:

Four hundred fifty square inches of oriented steel strip having a 0.1 mil cured coating of said irradiation curable solventless organic resin and capable of providing a 0 ampere Franklin test reading is immersed in about 375 ml of 10C hydrocarbon oil which initially has about a 39.0 dynes/cm Interfacial Tension Reading as measured above, and the 10C hydrocarbon oil is heated at a temperature of 120° C for 48 hours. In order to qualify, the oil must provide thereafter an interfacial tension reading of at least 30 dynes/cm.

A further surprising feature of the irradiation curable solventless resins employed in the practice of the invention is that when applied to the surface of oriented steel strip and cured in accordance with the practice of the invention, there is little or no change in the dimension of the strip sufficient to increase the magnetostriction of the transformer core material made therefrom. A test procedure which can be used to determine strain of the oriented steel strip resulting from the cured resin is the Epstein test ASTM A343.

There is provided by the present invention, a continuous, substantially pollution-free method for uniformly improving the surface resistivity of oriented steel strip having an inorganic material as a surface insulating coating to produce an oriented steel strip-inorganic coating-organic resin composite capable of providing an average Franklin test reading of from 0.1 to 0 amperes at a pressure of up to 300 psi, which comprises, 1. treating the oriented steel strip with an irradiation curable solventless organic resin to a thickness of up to 0.2 mil, and 2. passing the treated oriented steel strip through an irradiation curing zone at a rate of up to 600 feet per minute, using an irradiation flux sufficient to effect the cure of the solventless organic resin to an organic resin with a hardness capable of being tested by the above-described Franklin test, where said resin is characterized by having a viscosity of up to 3000 centipoises at 25° C, and is a mixture consisting essentially of from 99–1% by weight of organic monomer and correspondingly from 1–99% by weight of organic polymer, where said irradiation curable solventless orgaic resin is capable of providing with 10C hydrocarbon oil, an interfacial tension reading of from 30 to 40 dynes/cm in accordance with ASTMD971-50 (1970).

Included by the irradiation curable solventless organic resins which can be used in the practice of the invention are UV curable wax containing polyesters as particularly shown in U.S. Pat. No. 3,875,094 of Siegfried H. Schroeter and Ona Valys Orkin, and which aforesaid patent is assigned to the same assignee as the present invention. These UV curable wax containing polyesters can be more particularly defined as solventless organic resins having a viscosity of from 500 centipoises to 300 centipoises containing the following essential ingredients by weight:

A. 20 to 50% of a vinyl aromatic material selected from styrene, vinyl toluene, tert-butylstyrene and mixtures thereof, B. 80 to 60% of an unsaturated polyester reaction product of (i) a glycol and (ii) an aliphatically unsaturated organic dicarboxylic acid, where 1. is a glycol selected from the class consisting of
   a. a mixture of 20–60 mole percent of neopentyl glycol and 40–80 mole percent of a member selected from propylene
   b. a mixture of (i) 1 to 40% by weight thereof of trimethylolpropane monoallyl ether, and
2. is an aliphatically unsaturated organic dicarboxylic acid consisting essentially of a mixture of 50 to 65 mole percent of fumaric acid and 35 to 50 mole percent of a member selected from tetrahydrophthalic anhydride, endomethylene tetrahydrophthalic anhydride and mixtures thereof where there is utilized in making the unsaturated polyester reaction product of (B), up to at least about 10 mole percent excess of the glycol of (1) over the aliphatically unsaturated organic dicarboxylic acid of (2)

C 1% to 5% based on the weight of (A) and (B) of a UV sensitizer, and

D 0.05% to 1% based on the weight of (A), (B) and (C) of paraffin wax.

The above described unsaturated polyester can be made by standard techniques involving either a one-step or two-step reaction procedure. The two-step procedure can involve reacting the total glycol at temperatures up to about 200° C, which can consist of a mixure of propylene glycol and neopentyl glycol, with tetrahydrophthalic anhydride. A hydrocarbon azeotroping solvent can be employed to facilitate removal of water of reaction. Upon allowing the reaction mixture to cool, an acid number of from 1 to 25 indicates completion of the first stage of the reaction. The fumaric acid can then be added to the mixture with stirring and it is heated further until an acid number of 5 to 15 is obtained. In the one stage cook procedure, the acid number may be as high as 30.

In preparing the UV curable polyester composition, the vinyl aromatic solvent containing the paraffin wax and inhibitor can be added with stirring to the above prepared unsaturated polyester reaction product while it is warm. After the mixture has been allowed to cool to room temperature, an effective amount of the UV sensitizer can be added.

In addition to the above-described wax containing polyesters, there also can be used acrylic resins such as reaction products of acrylic or methacrylic acid with bisphenol A - diglycidyl ether, known for example, as Shell Epocryl 301, dissolved in styrene, vinyl toluene, hydroxypropyl acrylate or hydroxypropyl methacrylate, or certain multifunctional acrylates such as trimethylol propane triacrylate, etc. Other acrylic resins may be those derived from the reaction of hydroxyl terminated polyester glycols, etc. with diisocyanates and hydroxyl containing acrylates and methacrylates, or may contain randomly pendant acrylate or methacrylate unsaturation. The cure of these resins is accomplished by the free radical polymerization or copolymerization of said pending groups with those of the monomer molecules, the free radicals being generated by the UV-activated sensitizer.

Another class of resins may include UV-curable epoxy resins, for example, as described in U.S. Pat. Nos. 3,708,296; 3,721,616; and 3,721,617. Such resins may consist of bisphenol A diglycidyl ethers such as Epon Resins produced by Shell Chemical Co.; epoxidized phenol or cresol novolak resins such as produced by Dow Chemical Co. and Ciba Corporation or blends of such epoxy resins with epoxide monomers such as 1,2-epoxy-4-(epoxyethyl) cyclohexane; (3,4-epoxycyclohexyl)methyl 3,4-epoxy cyclohexane carboxylate, allyl glycidyl ether, etc., or mixtures thereof. These epoxy resins may be cured by a cationic mechanism initiated by the UV-activated sensitizer.

Additional UV curable epoxy resin compositions which can be used in the practice of the method of the present invention are shown in the copending applications Ser. No. 466,374, Ser. No. 466,375 and Ser. No. 446,378 of James V. Crivello filed concurrently on 5/2/74 and assigned to the same assignee as the present invention now all abandoned.

The term "epoxy resin" as utilized in the description of the curable compositions of the present invention, includes any monomeric, dimeric or oligomeric or polymeric epoxy material containing one or a plurality of epoxy functional groups. For example, those resins which result from the reaction of bisphenol-A (4,4'-isopropylidenediphenol) and epichlorohydrin, or by the reaction of low molecular weight phenol-formaldehyde resins (Novolak resins) with epichlorohydrin, can be used alone or in combination with an epoxy containing compound as a reactive diluent. Such diluents as phenyl glycidyl ether, 4-vinylcyclohexene dioxide, limonene dioxide, 1,2-cyclohexene oxide, glycidyl acrylate, glycidyl methacrylate, styrene oxide, allyl glycidyl ether, etc., may be added as viscosity modifying agents.

In addition, the range of these compounds can be extended to include polymeric materials containing terminal or pendant epoxy groups. Examples of these compounds are vinyl copolymers containing glycidyl acrylate or methacrylate as one of the cononomers. Other classes of epoxy containing polymers amenable to cure using the above catalysts are epoxy-siloxane resins, epoxy-polyurethanes and epoxy-polyesters. Such polymers usually have epoxy functional groups at the ends of their chains. Epoxy-siloxane resins and method for making are more particularly shown by E. P. Plueddemann and G. Fanger, J. Am. Chem. Soc. 81 632-5 (1959). As described in the literature, epoxy resins can also be modified in a number of standard ways such as reactions with amines, carboxylic acids, thiols, phenols, alcohols, etc. as shown in U.S. Pat. Nos. 2,935,488; 3,235,620; 3,369,055; 3,379,653; 3,398,211; 3,403,199; 3,563,805; 3,567,797, 3,677,995, etc. Further examples of epoxy resins which can be used are shown in the Encyclopedia of Polymer Science and Technology, Vol. 6, 1967, Interscience Publishers, New York, pp 209–271.

Some of the photoinitiators which can be used in combination with the epoxy resins, as defined above, in a proportion of from about 0.1% to 15% by weight based on the weight of UV curable compositions have the formula:

$$[Y]_j^{+}[MD_K]^{-(k-n)}$$

where M is a metal or metalloid, and D is a halogen radical, such as I, Br, Cl, etc., and Y is a cation selected from the class consisting of $$,\ [(R)_a(R_1)_b Q]^-$$
$$[(R)_c(R^2)_d(R^3)_e X]^+,$$
$$[(R)_f(R^4)_g(R^5)_h Z]^-,$$

where R is a monovalent aromatic organic radical, $R^1$ is a divalent aromatic organic radical, $R^2$ is a monovalent organic aliphatic radical selected from alkyl, cycloalkyl and substituted alkyl, $R^3$ is a polyvalent organic radical forming a heterocyclic or fused ring structure selected from aliphatic radicals and aromatic radicals, $R^4$ is a monovalent organic aliphatic radical selected from alkyl, alkoxy, cycloalkyl and substituted derivatives thereof, $R^5$ is a polyvalent organic radical forming an aromatic heterocyclic or fused ring structure with Z, Q is a halogen radical such as I, Br, Cl, etc., X is a Group VIa element selected from sulfur, selenium and tellurium, Z is a Group Va element selected from N, P, As, Sb and Bi, $a$ is a whole number equal to 0 or 2, $b$ is a whole number equal to 0 or 1, the sum of $a+b$ is equal to 2 or the valence of Q, $c$ is a whole number equal to 0 or 3, $d$ is a whole number equal to 0 to 2 inclusive, $e$ is a whole number equal to 0 or 1, where the sum of $c+d+e$ is a value equal to 3 or the valence of X, $f$ is a whole number equal to 0 to 4 inclusive, $g$ is a whole number equal to 0 to 2 inclusive, and $h$ is a whole number equal to 0 to 2 inclusive, and the sum of $f+g+h$ is a value equal to 4 or the valence of Z.

$j = k - N$

1 = valence of M and is an integer equal to 2 to 7 inclusive, and $k$ is >1 and is an integer having a value up to 8.

Radicals included by R can be the same or different, aromatic carbocyclic or heterocyclic radical having from 6 to 20 carbon atoms, whih can be substituted with from 1 to 4 monovalent radicals selected from $C_{(1-8)}$ alkoxy, $C_{(1-8)}$ alkyl, nitro, chloro, etc., R is more particularly phenyl, chlorophenyl, nitrophenyl, methoxyphenyl, pryidyl, etc. Radicals included by $R^1$ are divalent radicals such as

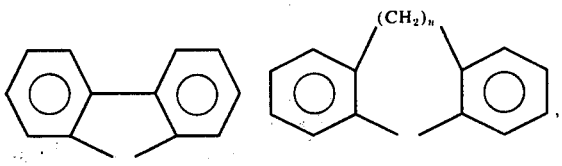

$R^2$ radicals include $C_{(1-8)}$ alkyl such as methyl, ethyl, etc., substitued alkyl such as $-C_2H_4OCH_3$, $-CH_2COOC_2H_5$, $-CH_2COCH_3$, etc. $R^3$ radicals include such structures as:

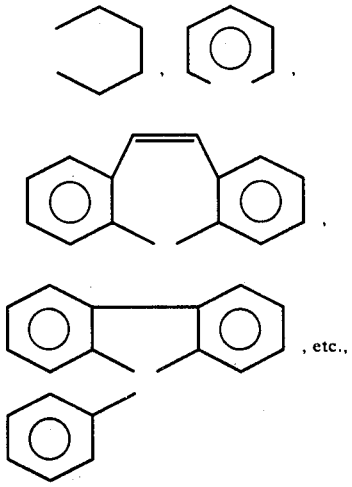

$R^4$ radicals include $C_{(1-8)}$ alkyl, $C_{(3-8)}$ cycloalkyl, substituted alkyl such as haloalkyl, for example, chloroethyl; alkoxy such as $OCH_2C_6H_5$ and $OCH_3$; alkoxyalkyl such as $-C_2H_4OCH_3$, etc. Radicals included by $R^5$ are, for example,

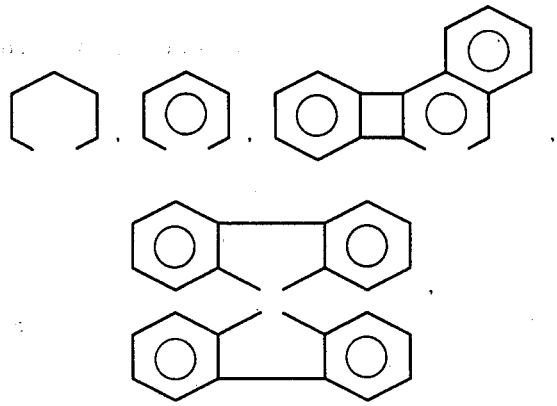

-continued

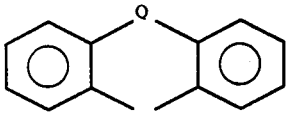

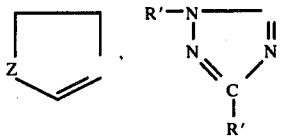

where Q′ is selected from O, $CH_2$, N, R and S; Z is selected from —O—, —S— and

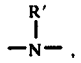

and R′ is a monovalent radical selected from hydrogen and hydrocarbon.

Halonium salts included by Formula 1 are, for example,

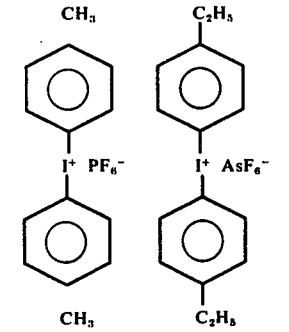

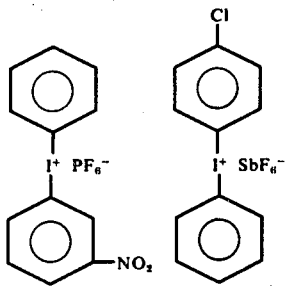

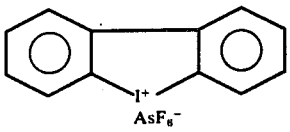

Group VIa onium salts included by by Formula 1 are, for example,

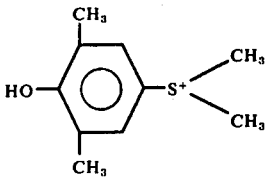

$AsF_6^-$

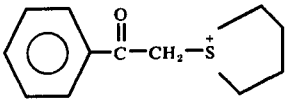

$PF_6^-$

-continued

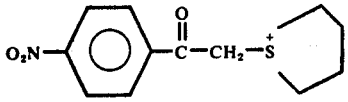

$AsF_6^-$

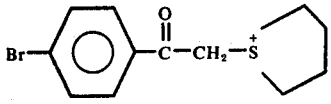

$SbF_6^-$

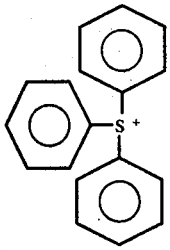

$SbF_6^-$

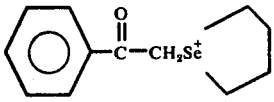

$PF_6^-$

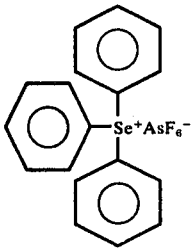

$SbF_6^-$, etc.

Group Va onium salts included by Formula 1 are, for example,

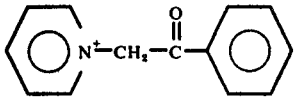

$SbF_6^-$,

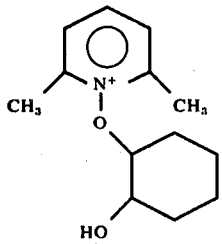

$AsF_6^-$,

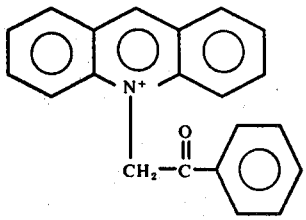

$PF_6^-$,

-continued

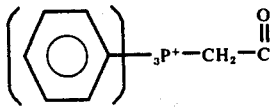

$AsF_6^-$,

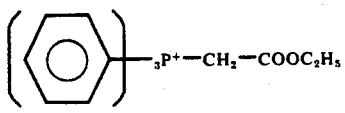

$PF_6^-$.

The curable compositions of the present invention can be made by blending the epoxy resin, which hereinafter will signify epoxy monomer, epoxy prepolymer, oxirane containing organic polymers or a mixture thereof, with an effective amount of the halonium salt. The resulting curable composition which can be in the form of a varnish having a viscosity of from 1 centipoise to 100,00 centipoises at 25° C can be applied to a variety of substrates by conventional means and cured to the tack-free state within 1 second or less to 10 minutes or more. In other instances, where the epoxy resin is a solid, the curable composition can be a free flowing powder.

Depending upon the compatability of the halonium salt with the epoxy resin, the halonium salt can be dissolved or dispersed therein along with an organic solvent such as nitromethane, acetonitrile, etc., prior to its incorporation. In instances where the epoxy resin is a solid, incorporation can be achieved by dry milling or by melt mixing. In situ preparation of the halonium salt by separate or simultaneous incorporation of halonium salt of the formula $$[(R)_a(R^1)_b X]^+ [Q']^-$$

where R, $R^1$, X *a* and *b* are as previously defined, and Q' is an anion such as $Cl^-$, $Br^-$, $F^-$, $I^-$, $HOS_4^-$, $CH_3SO_4^-$, $NO_3^-$, etc. with the salt of a Lewis Acid of the formula, $$M'[MQ]$$

also has been found to be effective, where [MQ ] is as defined above and M' is a metal cation such as $Na^+$, $K^+$, $Li^+$, $Ca^{++}$, $Mg^{++}$, $Fe^{++}$, $Ni^{++}$, $Co^{++}$, $Zn^{++}$. M' also can be an organic cation such as ammonium group, pyridinium group, etc. Examples of M'[MQ] are $NaBF_4$, $KAsF_6$, $NaSbF_6$, $KPF_6$.

Experience has shown that the proportion of halonium salt to the epoxy resin can vary widely inasmuch as the salt is substantially inert, unless activated. Effective results can be achieved, for example, if a proportion of from 0.1% to 15% by weight of halonium salt is employed, based on the weight of curable composition. Higher or lower amounts can be used, however, depending upon factors such as the nature of epoxy resin, intensity of radiation, cure time desired, etc.

Cure of the curable composition can be achieved by activating the halonium salt to provide the release of the Lewis Acid catalyst. Activation of the halonium salt can be achieved by heating the composition at a temperature in the range of from 150° to 250° C. Preferably cure can be achieved by exposing the curable composition to radiant energy such as electron beam or ultraviolet light. Electron beam cure can be effected at an accelerator voltage of from about 100 to 1000 KV. Cure of the compositions is preferably achieved by the use of UV irradiation having a wavelength of from 1849 A to 4000 A and an intensity of at least 5,000–80,000 microwatts per $cm^2$.

Among the UV radiation photosensitizers which can be used in the curable wax containing polyester compositions of the invention are, for example, ketones, such as benzophenone, acetophenone, benzil, benzyl methyl ketone; benzoins and substituted benzoins such as benzoin methyl ether, α-hydroxymethyl benzoin isopropyl ether; halogen containing compounds such as α-bromacetophenone, α-chloromethyl napthalene, sulfur compounds such as aromatic disulfides, and other photosensitizers such as azides, dyres, thioketones, or mixtures or synergistic mixtures thereof. Other compounds, at level which do not interfere with the cure, may also be added. Such compounds are, for example, inhibitors such as hydroquinone, tert-butyl hydroquinone, tert-butyl catechol, p-benzoquinone, 2,5-diphenylbenzoquinone, 2,6-tert-butyl-p-cresol, etc.; various fillers, flatting agents, thixotroptic agents, dyes and pigments such as barytes, blanc fixe, gypsum, calcium carbonate, quartz, diatomaceous silica, synthetic silica, clay, talc, asbestine, mica, bentonite, aerogels, glass fibers, ultramarine blue, etc. In addition to the aforedescribed ingredients, up to 2% and preferably 0.05 to 0.3% of a wax. Suitable waxes include, for example, low melting paraffin waxes having a melting point of about 40° to 60° C.

As shown in FIG. 1 of the drawing, a roller coater at 11 can be employed to continuously apply the irradiation curable organic resin onto the oriented steel strip at 10. The treated strip, in a preferred embodiment passes through a UV curing zone 12 to effect the cure of the organic resin on the surface of the oriented steel strip. However, if desired cure also can be effected by an electronbeam accelerator having an accelerator voltage of from about 150 to 3000 KV. The electrode current should as a rule have a strength between about 50 and 100 ma.

As indicated, cure of the organic resin is preferably effected by using UV irradiation which can have a wavelength of from 1849A to 4000 A. The lamp systems used to generate such radiation can consist of ultraviolet lamps such as from 1 to 50 discharge lamps, for example, xenon, metallic halide, metallic arc, such as a low, medium or high pressure mercury vapor discharge lamp, etc. having an operating pressure of from a few milli torr to about 10 atmospheres, etc., can be employed. The lamps can include envelopes capable of transmitting light of a wavelength of from about 1849 A to 4000 A, and preferably 2400 A to 4000 A. The lamp envelope can consist of quartz, such as Spectrocil or Pyrex, etc. Typical lamps which can be employed for providing ultraviolet radiation are, for example, medium pressure arcs, such as the GE H3T7 arc, etc. The cures may be carried out with a combination of various lamps, some or all of which can operate in an inert atmosphere. In operating the lamp to achieve a desirable level of flux intensity required for effecting cures of the solventless resin in a polution free manner, the lamps can be ballasted to provide a higher watts per inch input than that normally rated by the manufacturer. For example, the GE H3T7 lamp normally operated at 130 watts per inch, can be operated at up to 300 watts per inch input over a satisfactory operating life.

Figure 2:
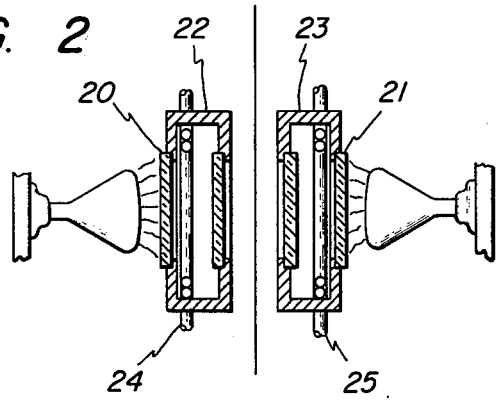

In addition to the above-described lamp means for generating ultraviolet radiation employed in the practice of the invention as shown in FIG. 2, the means for providing such ultraviolet radiation in the apparatus used therein also may include radiation filtering means, such as quartz windows at 20 and 21, employed in combination with the lamp and reflector to provide means for ultraviolet radiation having a wavelength of from between about 1849 A to 4000 A, while effecting the removal of radiation greater than 7500 A. The aforementioned windows can be made of any suitable material capable of transmitting ultraviolet at a wavelength of between 1849 A to 4000 A, such as quartz, Pyrez, Vycor, plastic sheets such as polymethylmethacrylate, etc. Typically, the fillers can be approximately the same size as the lamps or larger.

The thermal control means at 22 and 23 optionally can include support means for the radiation filters, which when separated to a satisfactory degree, such as 1 inch or more, can provide a channel, to allow for the passage of air or water, to remove heat from the radiation filters. Removal of heat also can be achieved by the employment of a cooling coil at 24 and 25 in instances where filter support means are employed.

The oriented steel strip which can be used in the practice of the invention can include any electrical or magnetic steel suitable as a core material for power transformers or magnetic core structures for motors, generators, and the like. Such steel can include silicon steel strip having a thickness of 5 to 50 mil, preferably 11–25 mil, and a width of 2 to 60 in.

It has been found advantageous to coat the oriented steel with up to 0.2 mil of resin and a rate of up to 100 to 600 feet per minute as sheet or continuous strip.

When using UV lamps, the irradiation flux in the substrate can be at least 0.01 watts per square inch to effectively cure the organic resin within 1 to 20 sec. and permit the steel strip to be taken up at a rate of from 100 to 600 feet per minute. The strip can be cut to a predetermined width for use as transformer laminate.

In order that those skilled in the art will be better able to practice the invention, the following examples are given by way of illustration and not by way of limitation. All parts are by weight.

EXAMPLE 1

A UV curable epoxy composition was prepared consisting of 66 parts of a low molecular weight epoxy novolac, DEN 431 supplied by Dow Chemical Co., 33 parts ofvinylcyclo hexene dioxide, and 3 parts of triphenylsolphonium hexafluoroantimonate. The resulting solution had a viscosity of 500 centipoises at room temperature, as measured with a Gardner Bubble Tube. The resin was coated onto panels of silicon steel at a 0.1 mil thickness and exposed in air to the irradiation of a commercial 200W /inch medium pressure mercury arc mounted in an elliptical reflector. The lamp was mounted over a conveyor system with a variable speed drive. The treated panels were subjected to the IFT oil contamination test as previously described and were found to have an average value of between 36.5 to 37.5 at conveyor speeds of up to 150 ft/min.

The above procedure was repeated, except the UV curable epoxy composition contained 1 part of sensitizer instead of 3 parts. The results obtained with the cured resin were substantially the same.

The cured resin on the treated panels experienced an improvement in properties by being allowed to postcure at room temperature over a period of about 48 hours. After that period, the coatings were not attacked by rubbing with or 5 hour immersion into solvents such as acetone, benzene or methylene chloride and showed only minor attack by boiling water (4 hour boil) or boiling 5% KOH solution (1.5 hour boil). The cured films also remained intact after 3,000 hours of heat aging in air at about 150° C to 160° C.

EXAMPLES 2–6

A variety of UV curable compositions were prepared from vinylcyclohexene dioxide (VCHD) various oxirane containing organic materials or "modifiers", and 1 part of $(C_6H_5)_3S^+SbF_6^-$sensitizer. The resulting resins were coated, cured, and tested as described in Example 1. The following results were obtained where "Vis" is the viscosity of the UV curable compositions in centipoises at 25° C:

| Ex. | VCHD (parts) | Modifier (parts) | Vis (cps) | IFT Value |
|---|---|---|---|---|
| 2 | 40 | Epoxy Novolac DEN 431[a] (60) | 300 | 35 |
| 3 | 40 | Epoxy Novolac DEN 438[a] (60) | 1,000 | 34 |
| 4 | 33 | Epoxy Novolac C-1139[b] (67) | 340 | 37 |
| 5 | 33 | Epoxy Novolac C-1138[b] (33) | 1,500 | 37 |
| 6 | 20 | Epou 828[c] (80) | 750 | 35 |

[a]Product of Dow Chemical Co., [b] Product of Ciba Geigy Corp., [c] Bisphenol A-diglycidyl ether, supplied by Shell Chemical Co.

EXAMPLES 7–8.

Example 1 was repeated except that 0.5% and 1.0% respectively of $(C_6H_5)_3S^+AsF_6^-$ were used as a catalyst. The following results were obtained:

| Example | Catalyst (pbw) | IFT Value |
|---|---|---|
| 7 | 0.5 | 34.0 |
| 8 | 1.0 | 35 |

EXAMPLE 9

A resin was prepared using part of $C_6H_5S^+AsF_6^-$ as catalyst, 99 parts of 3,4-Epoxycyclohexylmethyl -3,4-Epoxycyclohexane carboxylate (ECM) and 0.3 part of a silicone containing organic material. The resulting solution had a viscosity of 400 cps at 20° C, and 50 cps at 55° C. A sample of the resin, exposed as an 0.1 mil film, as described in Example 1, at a rate of 100 ft per min., gave an IFT value of 35.

EXAMPLES 10–13

UV curable compositions were prepared from 3,4-Epoxycyclohexylmethyl-3,4-Epoxycyclohexane carboxylate (ECM) and various amounts of "E7", a commercial mixture of alkyl glycidyl ethers

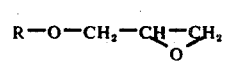

with R= 8-10 as a viscosity modifier, and 2 parts of $(C_6H_5)_3S^+AsF_6^-$ sensitizer. The following UV curable composition viscosities were obtained:

| Example No. | ECM (pbw) | E7 (pbw) | Viscosity (cps) 25° C |
|---|---|---|---|
| 10 | 97.5 | 2.5 | 330 |
| 11 | 95 | 5 | 280 |
| 12 | 90 | 10 | 200 |
| 13 | 80 | 20 | 60 |

The above UV curable compositions were applied to panels of silicon-steel as in Example 1 and provided acceptable IFT values.

EXAMPLE 14

A mixture of equal parts by weight of vinylcyclohexene dioxide and E7, a commercial mixture of alkyl glycidyl ethers as described in Example 13 and 1% by weight of the mixture of $(C_6H_5)_3\ S^+AsF_6$ was applied onto a steel strip. The applied UV curable epoxy blend was cured under ultra-violet light. The cured resin showed superior resistance to the effects of acetone when rubbed fifty times with an acetone saturated paper towel.

The above procedure was repeated, except that in place of the vinyl cyclohexene dioxide there was employed equal parts of bisphenol-A-diglycidyl ether with E7. It was found that the cured epoxy blend had substantially less resistance to the effects of acetone as compared to the epoxy blend containing the vinyl cyclohexene dioxide.

Although the above examples are limited to only a few of the very many UV curable epoxy organic resins which can be used in the practice of the present invention, it should be understood that the method of the present invention includes the use of a much broader variety of epoxy resins as shown in the description preceeding these examples. It is also significant to those skilled in the art that the preferred epoxy resins used in the practice of the present invention contain material having a cycloaliphatic structure such as vinylcyclohexene dioxide which have found to impart improved IFT values and solvent resistance to oriented steel either in a continuous manner or a procedure involving the treatment of cut steel strips or sheets to produce transformer core laminate.

What we claim as new and desire to secure by Letters Patent of the United States is:

1. A substantially pollution-free method for uniformally improving the surface resistivity of oriented steel strip having an inorganic material as a surface insulating coating to produce an oriented steel strip-inorganic coating-organic resin composite capable of providing an average Franklin test reading of from 0.1 to 0 amperes at a pressure of up to 300 psi, which comprises, 1. treating the oriented steel strip with a UV curable solventless epoxy organic resin to a thickness of up to 0.2 mil, and
2. passing the treated oriented steel strip through an irradiation curing zone at a rate of up to 600 feet per minute, using an irradiation flux sufficient to effect the cure of the solventless epoxy organic resin to an organic resin hardness capable of being tested by the above-described Franklin test, where said UV curable epoxy organic resin is characterized by having a viscosity of up to 3,000 centipoises at 25° C, and is a mixture comprising by weight A. from 30 to 99% of a cycloaliphatic epoxy compound, B. from 1 to 70% by weight of an oxirane containing organic material substantially free of cycloaliphatic radicals having a viscosity of less than 3,000 centipoises at 50° C and a molecular weight of less than 1,000, and C. from 0.5 to 5% by weight of an onium salt, where the sum of (A), (B) and (C) is 100%, and said onium salt has the formula, $$[Y]\ j^+\ [MD_k]^{-(k-n)}$$

where M is a metal or metalloid, and D is a halogen radical, Y is a cation selected from the class consisting of $$[(R)_a(R^1)_b\ Q]^+\ [(R)_c(R^2)_d\ (R^3)_e\ X]^+\ [(R)_f(R^4)_g\ (R^5)_h\ X]^+$$

where R is a monovalent aromatic organic radical, $R^1$ is a divalent aromatic organic radical, $R^2$ is a monovalent organic aliphatic radical selected from alkyl, cycloalkyl and substituted alkyl, $R^3$ is a polyvalent organic radical forming a heterocyclic or fused ring structure selected from aliphatic radicals and aromatic radicals, $R^4$ is a monovalent organic aliphatic radical selected from alkyl, alkoxy, cycloalkyl and substituted derivatives thereof, $R^5$ is a polyvalent organic radical forming an aromatic heterocyclic or fused ring structure with Z, Q is a halogen radical, X is a Group VI*a* element selected from sulfur, selenium and tellurium, Z is a Group V*a* element selected from N, P, As, Sb and Bi, *a* is a whole number equal to 0 or 2, *b* is a whole number equal to 0 or 1, the sum of $a + b$ is equal to 2 or the valence of Q, *c* is a whole number equal to 0 or 3, *d* is a whole number equal to 0 to 2 inclusive, *e* is a whole number equal to 0 or 1, where the sum of $c + d + e$ is a value equal to 3 or the valence of X, *f* is a whole number equal to 0 to 4 inclusive, *g* is a whole number equal to 0 to 2 inclusive, and *h* is a whole number equal to 0 to 2 inclusive and the sum of $f + g + h$ is a value equal *to* 4 or the valence of Z, $j = k - n$ n = valence of M and is an integer equal to 2 to 7 inclusive, and

*k* is >n and is an integer having a value up to 8, where said irradiation curable solventless epoxy organic resin is capable of providing with 10C hydrocarbon oil, an interfacial tension reading of from 30–49/cm in accordance with ASTM D971-50 (1970).

2. A method in accordance with claim 1, where the cycloaliphatic epoxy compound is vinylcyclohexene dioxide.

3. A method in accordance with claim 1, where the oxirane containing organic material is an expoxide having the formula,

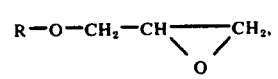

where R is an alkylene radical having from 8 to 10 carbon atoms.

4. A method in accordance with claim 1, where the cycloaliphatic epoxy compound is 3,4-epoxy cyclohexylmethyl-3,4-epoxy cyclohexene carboxylate.

5. A method in accordance with claim 1, where cycloaliphatic epoxy compound is bis(2,3-epoxy cyclopentyl) ether.

6. A method in accordance with claim 1, where cycloaliphatic epoxy compound is bis(3,4-epoxy-6-methylcyclohexylmethyl adipate.

7. A method in accordance with claim 1, where the onium salt is triphenyl sulfonium hexafluoroantimonate.

8. A method in accordance with claim 1, where the onium salt is triphenyl sulfonium hexafluoroarsonate.

* * * * *